US007603074B2

(12) United States Patent
Yamaguchi

(10) Patent No.: US 7,603,074 B2
(45) Date of Patent: Oct. 13, 2009

(54) IMAGE FORMING SYSTEM, IMAGE FORMING DEVICE AND BOOKBINDING DEVICE

(75) Inventor: Hiroshi Yamaguchi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 484 days.

(21) Appl. No.: 11/634,464

(22) Filed: Dec. 5, 2006

(65) Prior Publication Data

US 2007/0217846 A1 Sep. 20, 2007

(30) Foreign Application Priority Data

Mar. 17, 2006 (JP) ..... 2006-074149

(51) Int. Cl.
*G03G 15/00* (2006.01)

(52) U.S. Cl. ..... 399/408; 412/4; 412/19

(58) Field of Classification Search ..... 399/408; 412/4, 19

See application file for complete search history.

(56) References Cited

U.S. PATENT DOCUMENTS 3,572,767 A * 3/1971 Learned et al. ..... 281/34
4,371,194 A * 2/1983 Wang et al. ..... 281/21.1
2002/0163119 A1* 11/2002 Kawata ..... 271/207
2004/0120793 A1* 6/2004 Parker ..... 412/8
2005/0095086 A1* 5/2005 Cobene et al. ..... 412/8

FOREIGN PATENT DOCUMENTS

JP 2004-209869 A 7/2004

* cited by examiner

*Primary Examiner*—Judy Nguyen
*Assistant Examiner*—Allister Primo
(74) *Attorney, Agent, or Firm*—Frishauf, Holtz, Goodman & Chick, P.C.

(57) ABSTRACT

An image forming system forms an image on body sheets and wraps, in a square shape, a stack of the body sheets having the image formed thereon with a cover to bind a book. The image forming system includes a relative-position related information input section for input of information related to a relative position between the cover and the stack of the body sheets; a storage section for storing the information related to the relative position, corresponding to a job; and a relative position control section for control of the relative position between the cover and the stack of the body sheets, based on the information related to the relative position stored in the storage section.

13 Claims, 10 Drawing Sheets

IMAGE FORMING SYSTEM, IMAGE FORMING DEVICE AND BOOKBINDING DEVICE

This application is based on Japanese Patent Application No. JP2006-074149 filed on Mar. 17, 2006, the entire of which is hereby incorporated by reference.

FILED OF THE INVENTION

The present invention relates to an image forming system, image forming device and bookbinding device.

BACKGROUND OF THE INVENTION

There is known an image forming system constructed with an image forming device and bookbinding device. In an image forming system disclosed in Patent Document 1 (Japanese Unexamined Patent Publication TOKKAI No. 2004-209869), for example, a stack of sheets for the body of a book (also referred to as a body), which will be the content of the book, is wrapped with a cover in a square shape, and the spine of the stack of sheets for the body is attached to the cover with glue, thereby performing so-called wrap-bookbinding to form a book.

Further, in the system disclosed in Patent Document 1, a cover is cut, based on the size of a body (the size of sheets for the body and the thickness of a stack of the sheets), and the cut cover is conveyed and stopped at a predetermined position. The stop position of the cover is properly set to a position where the edges of the cover are aligned with the edge of the body when the body is wrapped with the cover.

In Patent Document 1, it is assumed that a cover in a size that accords with the size of the body is fed. However, a case where the size of a body and that of the cover are different is not considered.

For example, with regard to wrap-bookbinding, there is a case where bookbinding is performed such that a book is formed by cutting the fore edge after wrapping a body with a cover in an approximate size capable of wrapping the body and attaching the cover to the body with glue, and there is also a case where bookbinding is performed by wrapping a body intentionally with a cover in a different size from the body.

The present invention was developed to solve problems with cases, as described above, and an object of the invention is to provide an image forming system applicable to various cases of wrap-bookbinding.

SUMMARY OF THE INVENTION

In an aspect of the invention, there is provided an image forming system that forms an image on body sheets and wraps, in a square shape, a stack of the body sheets having the image formed thereon with a cover to bind a book, including:

a relative-position related information input section for input of information related to a relative position between the cover and the stack of the body sheets;

a storage section for storing the information related to the relative position, corresponding to a job; and a relative position control section for control of the relative position between the cover and the stack of the body sheets, based on the information related to the relative position stored in the storage section.

In another aspect of the invention, there is provided an image forming device that forms an image on body sheets and is connectable with a bookbinding device, the bookbinding device performing bookbinding by wrapping, in a square shape, a stack of the body sheets having the image formed thereon with a cover, the image forming device including:

a relative-position related information input section for input of information related to a relative position between the cover and the stack of the body sheets;

a storage section for storing the information related to the relative position, correspondingly to a job; and a transmitting section for transmitting the information related to the relative position stored in the storage section, to the bookbinding device.

In still another aspect of the invention, there is provided a bookbinding device that is connectable to an image forming device that forms an image on body sheets and performs bookbinding by wrapping, in a square shape, a stack of the body sheets having the image formed thereon with a cover, the bookbinding device including:

a receiving section for receiving information related to a relative position between the cover and the stack of the body sheets, on a job to job-basis, from the image forming device; and a relative position control section for control of the relative position between the cover and the stack of the body sheets, based on the information related to the relative position and received by the receiving section.

BRIEF DESCRIPTION OF THE DRAWINGS

FIGS. 2*a* to 2*c* are diagrams showing an example of image forming on a cover in accordance with the present embodiment, wherein FIG. 2*a* is a diagram showing a cover with an image formed thereon in advance and is stored in a sheet feeding cassette, FIG. 2*b* is a diagram showing an image to be formed on a cover by an image forming device, and FIG. 2*c* is a diagram showing a composite image for which the image in FIG. 2*b* is formed on the cover in FIG. 2*a;*

FIGS. 3*a* and 3*b* are diagrams showing examples of image forming on a body sheet, wherein FIG. 3*a* is a diagram showing an example of image forming on a body sheet, in accordance with the preset embodiment, and FIG. 3*b* is a diagram showing a case of image forming at the center of a body sheet;

FIGS. 4*a* and 4*b* are schematic diagrams of the states of wrapping a body with a cover, viewed from the bottom of the book, wherein FIG. 4*a* is a schematic diagram for a case where the position of the front edge of a cover is not adjusted, and FIG. 4*b* is a schematic diagram for a case where the position of the front edge of a cover is adjusted in accordance with the present embodiment;

FIGS. 5*a* and 5*b* are schematic diagrams showing the stop position of a cover at a cover joining portion, wherein FIG. 5*a* is a schematic diagram for a case where the position of the front edge of a cover is not adjusted, and FIG. 5*b* is a schematic diagram for a case where the position of the front edge of a cover is adjusted in accordance with the present embodiment;

DETAIL DESCRIPTION OF THE PREFERRED EMBODIMENT (Mechanical Structure)

Figure 1:
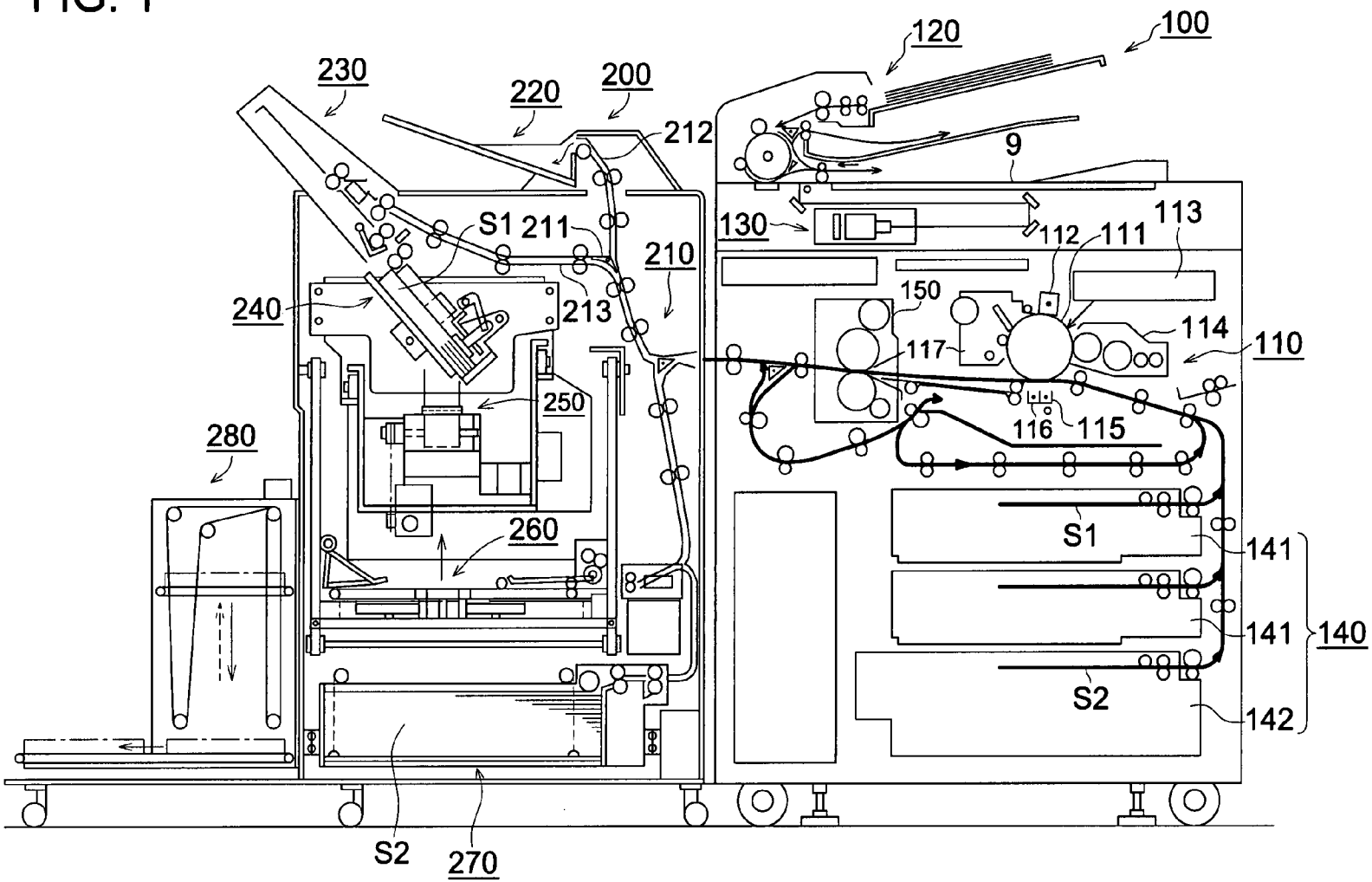
FIG. 1 is a diagram showing a mechanical structure of an image forming system in accordance with the present embodiment.

FIG. 1 is a diagram showing a mechanical structure of an image forming system in accordance with the present embodiment. The image forming system is constructed with an image forming device 100 and a bookbinding device 200.

The image forming device 100 forms an image on a sheet by an electrophotographic method, and includes an image forming section 110, original document sheet conveying section 120, and image reading section 130.

In the image forming section 110, there are disposed a charging device 112, exposure device 113, developing device 114, transfer device 115, separation device 116, and cleaning device 117 around a photoreceptor 111 in a drum shape, and each process of charging, exposure, development, and transfer is executed so as to form a toner image on a body sheet S1 or cover S2.

For bookbinding, body sheets S1 which will be wrapped in a cover S2 are stored in two sheet feeding cassettes 141, and covers S2 are stored in a sheet feeding cassette 142 and a cover feeding section 270 of the bookbinding device 200. The sheet feeding cassettes 141 and 142 construct a sheet feeding section 140. A sheet is fed from the sheet feeding cassette 142 in the case of forming an image on a cover S2, and a sheet is fed form the cover feeding section 270 in the case of not forming an image on a cover S2.

A body sheet S1 or cover S2 fed from a sheet feeding cassette 141 or 142 is conveyed to the image forming section 110 one by one. A body sheet S1 or cover S2 having a toner image transferred thereon passes through a fixing device 150 and is subjected to fixing processing. The body sheet S1 or cover S2 having been subjected to fixing processing is ejected outside the image forming device 100.

The bookbinding device 200 bundles a plurality of body sheets S1 fed from the image forming device 100 to form a bundle of sheets, joins a cover S2 to the bundle, and wraps the bundle of sheets in a square shape with the cover, thereby forming a book.

The bookbinding device 200 includes a sheet accumulating section 230, sheet stack holding section 210, coating section 250, and cover joining section 260 for joining a cover to a sheet bundle, and further includes a conveying section 210, sheet ejection tray 220, and book ejection section 280.

A body sheet S1 conveyed from the image forming device 100 to the bookbinding device 200 is ejected by a switching gate 211 provided in a conveying section 210 to the sheet ejection tray 220 through an ejection path 212, or conveyed to the sheet accumulating section 230. A body sheet S1 is ejected to the sheet ejection tray 220 when bookbinding is not performed by the bookbinding device 200.

In performing bookbinding operation in the bookbinding device 200, a body sheet S1 is conveyed through a conveying path 213 to the sheet accumulating section 230. A body sheet S1 in the sheet accumulating section 230 is switched back and then conveyed to a sheet stack holding section 240. Body sheets S1 in a set number are held by the sheet stack holding section 240, and then the sheet stack holding section 240 rotates to hold the stack of the body sheet S1 substantially vertically. Then, an adhesive is coated by the coating section 250 on the bottom surface, namely the spine, of the stack of the body sheets S1.

On the other hand, a cover S2 is conveyed to the cover joining section 260 and stopped at a predetermined position. Then, the cover joining section 260 rises, by which the cover S2 comes in contact with the bundle of the sheets coated with the adhesive and adhered to the bundle of the body sheets. Thus, a book is formed and ejected to the book ejection section 280.

Brief Description of the Present Embodiment

In the present embodiment, bookbinding through which a sheet S2 and body sheets S1 are cut after wrapping a body with the cover S2 will be described as an example. However, the invention is not limited thereto.

Figure 2:
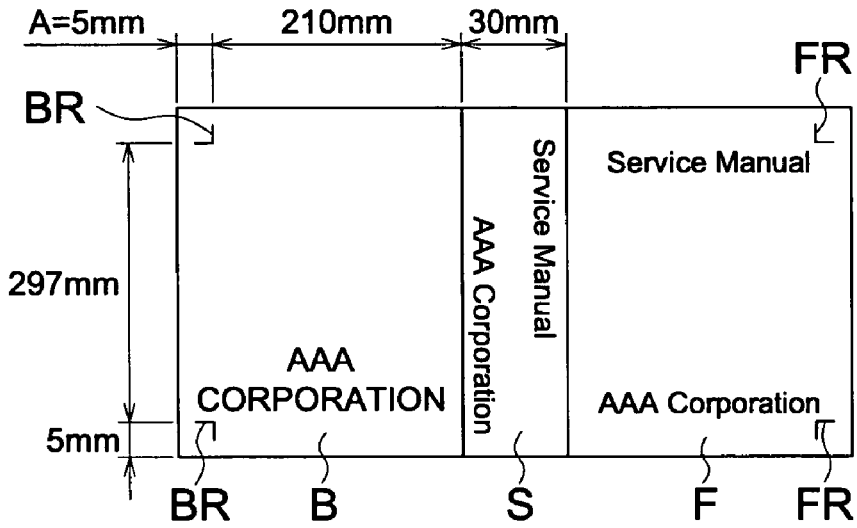
Figure 2:
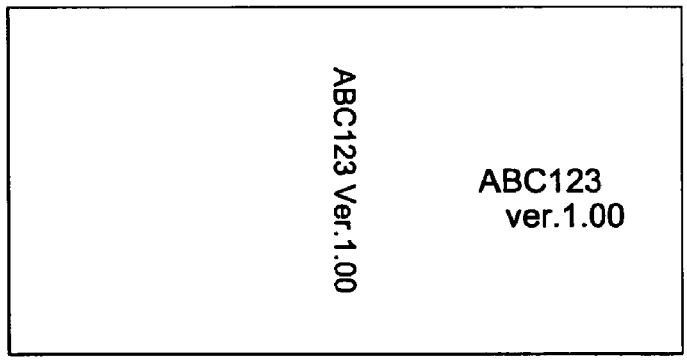
Figure 2:
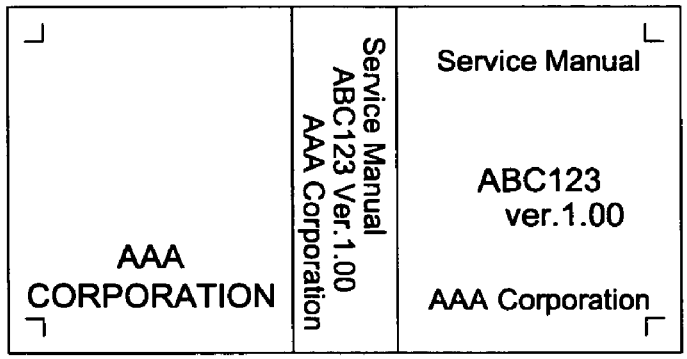

FIGS. 2*a* to 2*c* are diagrams showing an example of image forming on a cover, in accordance with the present embodiment. FIG. 2*a* shows a cover S2, stored in the sheet feeding cassette 142, on which an image is formed in advance. FIG. 2*b* shows an image to be formed on the cover S2 by the image forming device 100. FIG. 2*c* shows a composite image obtained by forming the image, shown in FIG. 2*b*, on the cover S2, shown in FIG. 2*a*.

As shown in FIG. 2*a*, the cover S2 is an A3 size wide sheet, which is 460 mm×307 mm in size and is one size larger than an A3 size sheet (420 mm×297 mm). The cover S2 has three areas which are front cover area F, spine area S, and back cover area B disposed in this order from the right. The value of width of a spine area S is set to 30 mm in this example, based on the thickness of a body. Front cover register marks FR and back cover register marks BR are formed respectively on the front cover area F and the back cover area B. In each area, the area inside the register marks is equal to A4 size (210 mm×297 mm). After adhering the body and cover with adhesive, the area outside the register marks is cut and removed. In the present example, the distance A from a register mark to the edge of the cover S2 in the lateral direction of the sheet is 5 mm (A=5 mm).

As shown in FIG. 2*b*, for an image to be formed on the cover S2 by the image forming device 100, image data is generated such that the image is located at a proper relative position to an image that has been formed in advance on the cover S2. By generating image data in such a manner, a proper composite image is obtained, as shown in FIG. 2*c*.

Figure 3:
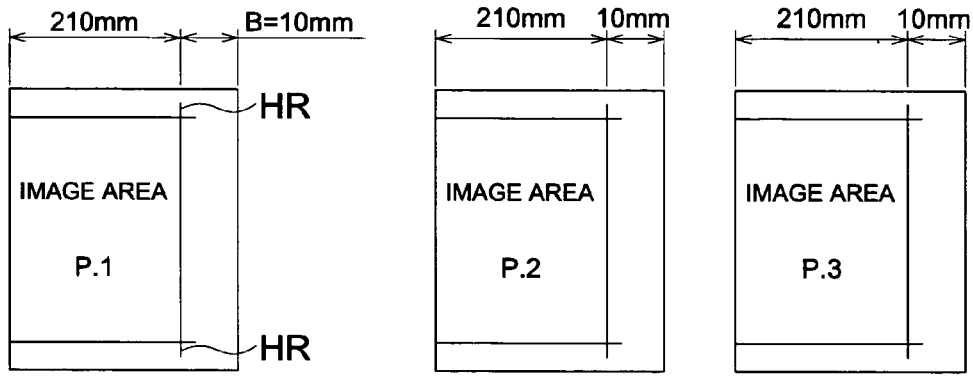
Figure 3:
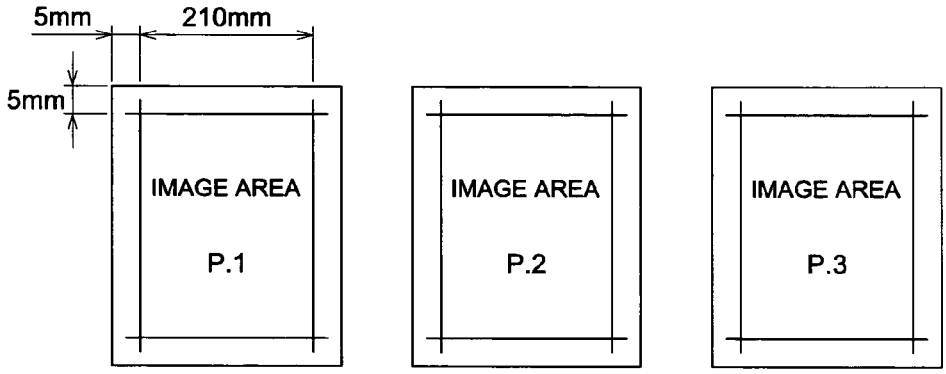

FIGS. 3*a* and 3*b* show examples of image forming on a body sheet. FIG. 3*a* is a diagram showing an example of image forming on a body sheet, in accordance with the present embodiment. FIG. 3*a* shows an image to be formed on a body sheet S1 stored in the sheet feeding cassette 141.

As shown in FIG. 3*a*, the body sheet S1 is 220 mm×307 mm in size, which is an A4 wide sheet being one size larger than A4 size (210 mm×297 mm). As shown, an image in A4 size is formed on the A4 wide sheet, shifted to the binding side (the left side in the figure). Body register marks HR are also formed, corresponding to the image in A4 size. The image is formed being shifted to the binding side, because an extra process is required to cut the margin on the binding side before adhering the body to the cover if an A4 image is formed at the center of the body sheet S1, as shown in FIG. 3*b*.

In FIG. 3*a*, the distance B from a body register mark HR to the edge of the body sheet S1 in the lateral direction of the sheet is 10 mm (B=10 mm).

Figure 4:
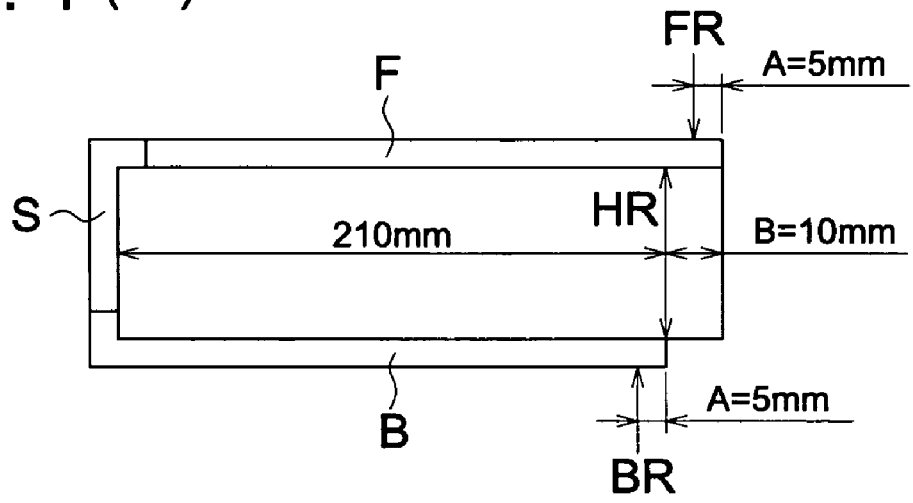
Figure 4:
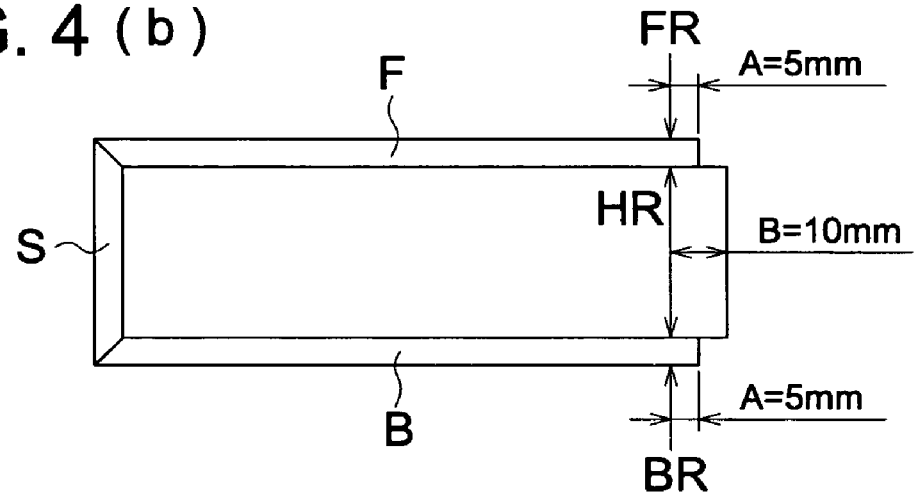

FIGS. 4*a* and 4*b* are schematic diagrams of the states of wrapping a body with a cover, viewed from the bottom of the book, wherein FIG. 4*a* is a schematic diagram for a case where the position of the front edge of a cover is not adjusted, and FIG. 4*b* is a schematic diagram for a case where the position of the front edge of a cover is adjusted in accordance with the present embodiment. FIGS. 4*a* and 4*b* show states where the stack of body sheets S1, shown in FIG. 3*a*, is wrapped with the cover sheet S2, shown in FIG. 2*c*.

In FIG. 4*a*, the body is wrapped in a state where the edge of the cover S2 on the front cover area F side in the lateral direction is aligned with the fore edge, on the fore edge side, of the body (the right side edge in the figure). As shown in FIG. 4*a*, front cover register marks FR would be arranged at the position that is A=5 mm inside from the front cover edge, namely at the position that is 5 mm inside from the fore edge of the body. Body register marks HR would be arranged at a position B=10 mm inside from the fore edge. Back cover register marks BR would be arranged at the position that is A=5 mm inside from the back cover edge, namely at the position that is 15 mm inside from the fore edge of the body. Accordingly, the respective register marks would be disposed at different positions, deviated from the fore edge of the body. If the cover S2 were cut, for example, at the position of the register marks HR of the body in this state, the cut position in the front cover area F is 5 mm inside from the position of the front cover register marks FR, by which the front cover image from the position of the front cove register marks FR to the position 5 mm inside from the front cover register marks FR would be lost. Further, the spine area S of the cover S2 would be deviated from the position of the spine of the book, as shown, disabling bookbinding in high quality.

On the other hand, FIG. 4*b* is a schematic diagram, viewed from the bottom of the book, of a state where the body is wrapped with the cover S2 in such a manner that the position of the front edge of the cover is adjusted (−5 mm, for example). The cover S2 is disposed with a shift of 5 mm toward the back cover area B, compared with the case of not adjusting the position of the front edge of the cover S2.

As shown in FIG. 4*b*, the front cover register marks FR are set to the position that is A=5 mm inside from the front cover edge, namely 10 mm inside from the fore edge. The body register marks HR are set to the position that is B=10 mm inside from the fore edge. The body register marks BR are set to the position that is A=5 mm inside from the back cover edge, namely 10 mm inside from the fore edge. That is, the positions of respective register marks are set to the same position 10 mm inside from the fore edge. When the body and cover are cut at the position 10 mm inside from the fore edge in this state, the body and cover are cut at the positions of the respective register marks, preventing any part of both the cover image and body images from missing. Further, the spine area S of the cover is properly positioned at the spine of the book to perform bookbinding in high quality.

FIGS. 5*a* and 5*b* are schematic diagrams showing the stop position of the cover S2 at the cover joining section 260. FIG. 5*a* shows the stop position of a case of not performing adjustment of the front edge position of the cover. FIG. 5*b* shows the stop position of a case of performing adjustment (−5 mm, for example) of the front edge position of the cover.

As shown by the arrow in the figure, a cover S2 is fed from the right side of the cover joining section 260 onto the cover joining section 260. The stop position of the cover S2 in FIG. 5*b* is 5 mm on the upstream side in the conveying direction from the stop position of the cover S2 in FIG. 5*a*.

A book as shown in FIG. 4*a* is obtained by adhering the cover S2 to the body, setting the position of the cover S2 as shown in FIG. 5*a*. A book as shown in FIG. 4*b* is obtained by adhering the cover S2 to the body, setting the position of the cover S2 as shown in FIG. 5*b*.

As described above, in the present embodiment, by adjusting the position of the front edge of a cover, the respective register marks, namely the front cover register marks FR, back cover register marks BR, and body register marks HR, can be aligned at the same position when the body is wrapped with the cover S2. Thus, any part of both the cover images and body images are prevented from getting lost by cutting the book at the register mark positions, thereby the spine area S of the cover is properly positioned at the spine of the book to perform bookbinding in high quality.

(Control Structure)

Figure 6:
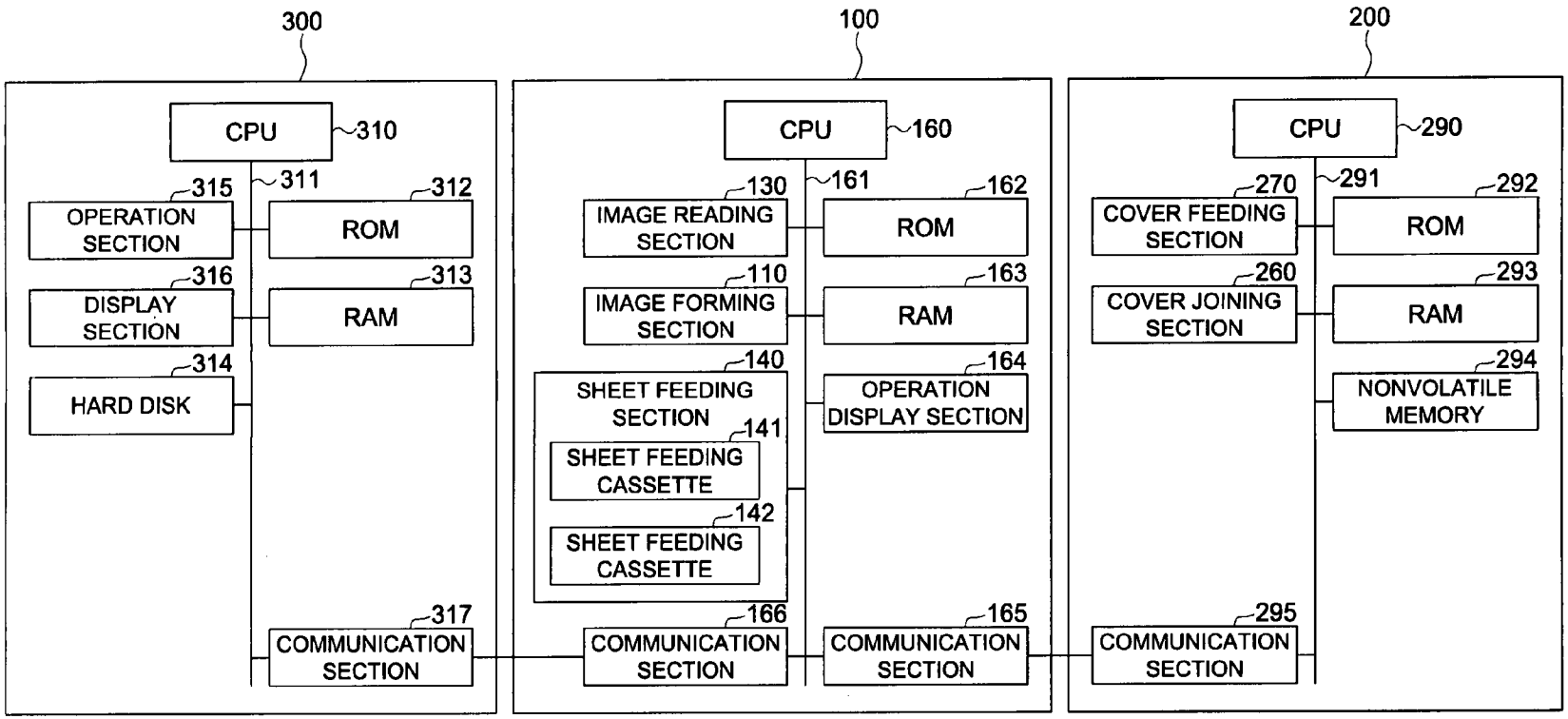
FIG. 6 is a diagram showing the structure of control in the image forming system in accordance with the present embodiment.

FIG. 6 is a diagram showing the structure of control in the image forming system in accordance with the present embodiment. The image forming system is constructed with the image forming device 100, bookbinding device 200, and a personal computer 300.

In the image forming device 100, a CPU 160 executes various controls of the image forming device 100, according to a program. Around the CPU 160 and via a bus 161, mutually connected are a ROM 162, RAM 163, image reading section 130, image forming section 110, sheet feeding section 140, operation display section 164, communication section 165, communication section 166, and others.

ROM 162 stores various programs and data, and CPU 160 executes control of the image forming device 100, using these programs and data.

RAM 163 is used by CPU 160 as a work area, and temporarily stores necessary programs and data when CPU 160 executes control.

The image reading section 130 reads original document sheets and generates image data. The generated image data is processed by CPU 160 and output to the image forming section 110.

The image forming section 110 performs image forming on sheets, based on image data inputted from the image reading section 130 or personal computer 300.

The sheet feeding section 140 conveys body sheets stored in the sheet feeding cassette 141 or a cover stored in the sheet feeding cassette 142 to the image forming section 110.

The operation display section 164 includes a touch-panel to perform display of various operation screens and instruction-input.

The communication section 165 is connected to the bookbinding device 200 and transmits and receives various data to and from the bookbinding device 200.

The communication section 166 is connected to the personal computer 300 and receives image data transmitted from the personal computer 300.

In the bookbinding device 200, a CPU 290 executes various controls of the bookbinding device 200, according to a program. Around the CPU 290 and via a bus 291, mutually connected are a ROM 292, RAM 293, the cover joining section 260, cover feeding section 270, communication section 295, and the like.

ROM 292 stores various programs and data, and CPU 290 executes control of the bookbinding device 200, using these programs and data.

RAM 293 is used as a work area by CPU 290 and temporarily stores programs and data that are necessary when CPU 290 executes control.

The cover joining section 260 stops a cover S2 conveyed from the cover feeding section 270 at a predetermined position and then rises. Then, the cover S2 is adhered to a body on which glue has been coated.

The cover feeding section 270 conveys a stored cover S2 to the cover joining section 260.

A communication section 295 is connected to the image forming device 100, and transmits and receives various data to and from the image forming device 100.

In the personal computer 300, around a CPU 310 that executes control of the personal computer 300 according to a program, a bus 311 connects a ROM 312, RAM 313, hard disk 314, operation section 315, display section 316, communication section 317, and the like.

ROM 312 stores various programs and data, and CPU 310 executes control of the personal computer 300, using these programs and data.

ROM 313 is used as a work area by CPU 310 and temporarily stores programs and data that are necessary when CPU 310 executes control.

The hard disk 314 stores application programs for generation of image data, and stores a printer driver and the like.

A user operates the operation section 315 to perform various inputs on an application program screen, a printer driver screen, and the like.

The display section 316 displays the application program screen, printer driver screen, and the like.

The communication section 317 is connected to the image forming device 100 and transmits image data to the image forming device 100.

(Control Flow)

[Image Data Input Processing]

Figure 7:
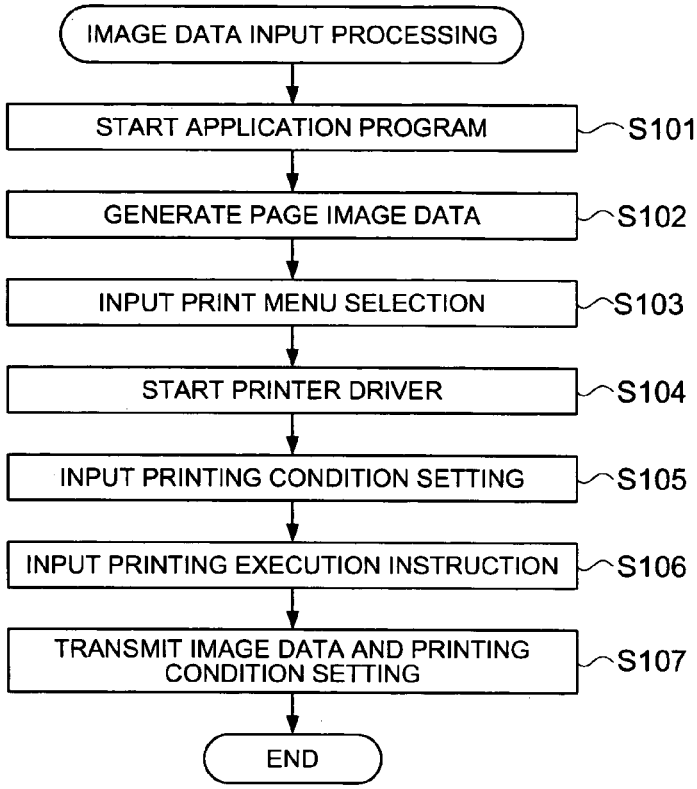
FIG. 7 is a diagram showing a control flow of image data input processing in accordance with the present embodiment.

In the present embodiment, image data is input via the personal computer 300. FIG. 7 shows a control flow of image data input processing in the present embodiment.

First, in the personal computer 300, upon instruction via the operation section 315 to start an application program, CPU 310 starts the application program, and loads the application program from the hard disk 314 to RAM 313 to display an application screen on the display section 316 (step S101). Then, upon input via the operation section 315 on the application program screen, CPU 310 creates cover image data, shown in FIG. 2*b*, and body image data, shown in FIG. 3*a* (step S102).

Then, upon selection of a print menu on the application program screen via the operation section 315 (step S103), CPU 310 starts a printer driver, loads the printer driver from the hard disk 314 into RAM 313, and displays the printer driver screen on the display section 316 (step S104).

Then, printing conditions are set on the printer driver screen via the operation section 315, such as, wrap-binding setting, cover cassette setting, body sheet cassette setting, cover-front-edge-position adjustment setting, body image-data shift-amount setting, so as to be input to CPU 310 (step S105). These printing conditions can be set on a job to job basis. Herein, printing condition settings including cover-front-edge-position adjustment are stored in RAM 313, in association with cover image data and body image data of a job.

Then, upon instruction to execute printing via the operation section 315 (step S106), CPU 310 transmits this instruction to execute printing, the cover image data and body image data generated in step S102, and printing condition settings inputted in step S105 to the image forming device 100 via the communication section 317 (step S107). The image forming device 100 stores the received printing condition settings in RAM 163, in association with the cover image data and body image data.

[Image Forming Processing]

Figure 8:
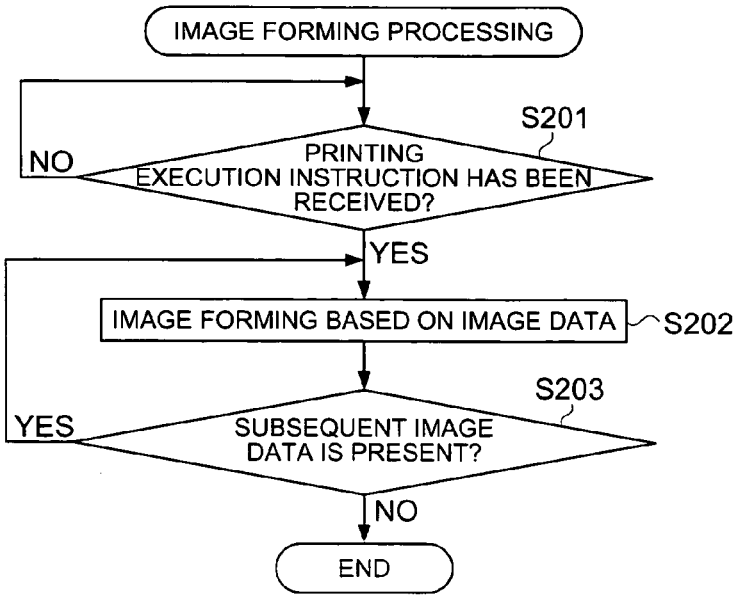
FIG. 8 is a diagram showing a control flow of image forming processing in accordance with the present embodiment.

Image forming processing is performed in the image forming device 100 such that CPU 160 executes processing of cover image data and body image data, based on a program stored in ROM 162 and referring to the printing condition settings stored in RAM 163. FIG. 8 shows a control flow of image forming processing in accordance with the present embodiment. Herein, it is assumed that respective conditions have been set, in step S105 of image data input processing, such that "wrap-binding setting: applied, cover sheet cassette: sheet feeding cassette 142, body sheet cassette: sheet feeding cassette 141, body-image-data shift-amount setting: 5 mm".

First, CPU 160 determines whether or not the image forming device 100 has received an instruction to execute printing, via the communication section 166 (step S201). If CPU 160 has determined that the image forming device 100 has received an instruction to execute printing (step S201; Yes), then CPU 160 starts image forming operation, based on the first image data (step S202). Herein, CPU notifies the bookbinding device of information on whether or not wrap-bookbinding setting is applied, on the cover-front-edge-position adjustment set value, and the like.

Body sheets S1 are fed from the sheet feeding cassette 141 for body image data, and a cover S2 is fed from the sheet feeding cassette 142 for cover image data, and images are formed on these sheets. With regard to the body image data for the body sheets S1, images are formed on the body sheets S1 with a shift of 5 mm to the binding side, according to a shift-amount setting: 5 mm. As a result, images are obtained, as shown in FIG. 3*a*, in such a manner that the edge of each image is aligned with the binding edge of the body sheet S1.

If CPU 160 has determined that the image forming device 100 has not received an instruction to execute printing (step S201; No), then CPU 160 stands by until an instruction to execute printing is received.

Next, CPU 160 determines whether or not a subsequent image data is present (step S203). If CPU 160 has determined that a subsequent image data is present (step S203; Yes), then the process returns to step S202, and CPU 160 executes image forming operation on the subsequent image data. If CPU 160 has determined that no subsequent image data is present (step S203; No), then CPU 160 terminates the flow.

[Bookbinding Processing]

Figure 9:
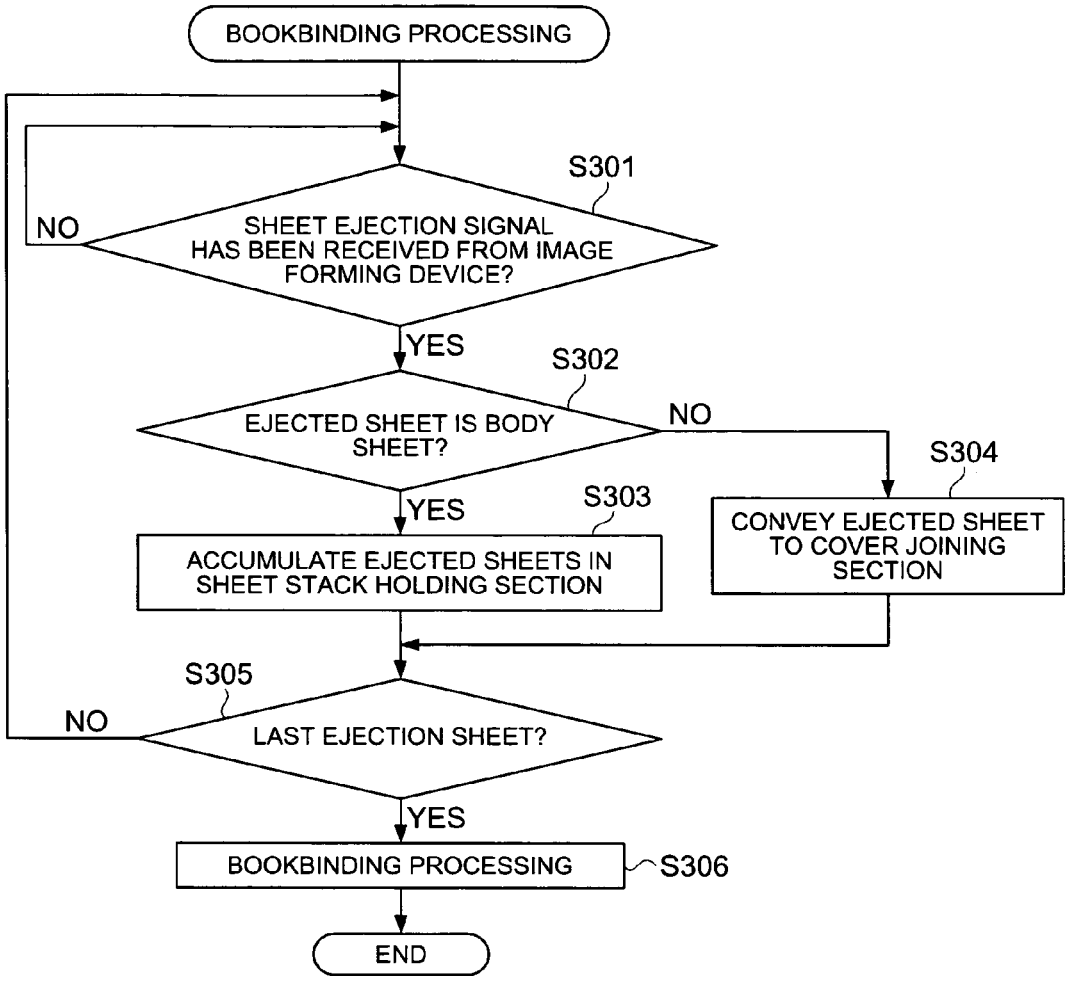
FIG. 9 is a diagram showing a control flow of bookbinding processing in accordance with the present embodiment.

Bookbinding is performed in the bookbinding device 200 such that CPU 290 executes processing, based on a program stored in ROM 292. FIG. 9 shows a control flow of bookbinding processing in accordance with the present embodiment. Herein, it is assumed that respective conditions have been set in step S105 for image data input processing such that "wrap-binding setting: applied, cover-front-edge-position adjustment setting value: −5 mm". The cover-front-edge-position adjustment setting value having been received from the image forming device 100 is stored in RAM 293 of the bookbinding device 200.

First, CPU 290 determines whether or not the bookbinding device 200 has received a sheet ejection signal transmitted via a communication section 295 from the image forming device 100 at the time of sheet ejection (step S301). A sheet ejection signal includes sheet information on the ejected sheet. If CPU 290 has determined that the bookbinding device 200 has received a sheet ejection signal (step S301; Yes), then CPU 290 determines whether or not the ejected sheet is a body sheet, based on the sheet information included in the sheet ejection signal (step S302). If CPU 290 has determined that the bookbinding device 200 has received no sheet ejection signal (step S301; No), then CPU 290 stands by until the bookbinding device 200 receives a sheet ejection signal.

In step S302, if CPU 290 has determined that the ejected sheet is a body sheet, based on the sheet information included in the sheet ejection signal (step S302; Yes), then CPU 290 accumulates the body sheet S1 in the sheet stack holding section 240 via the sheet accumulating section 230 (step S303). If CPU 290 has determined that the ejected sheet is not a body sheet, based on the sheet information included in the sheet ejection signal (step S302; No), then CPU 290 conveys the ejected sheet to the cover joining section 260 (step S304).

Figure 5:
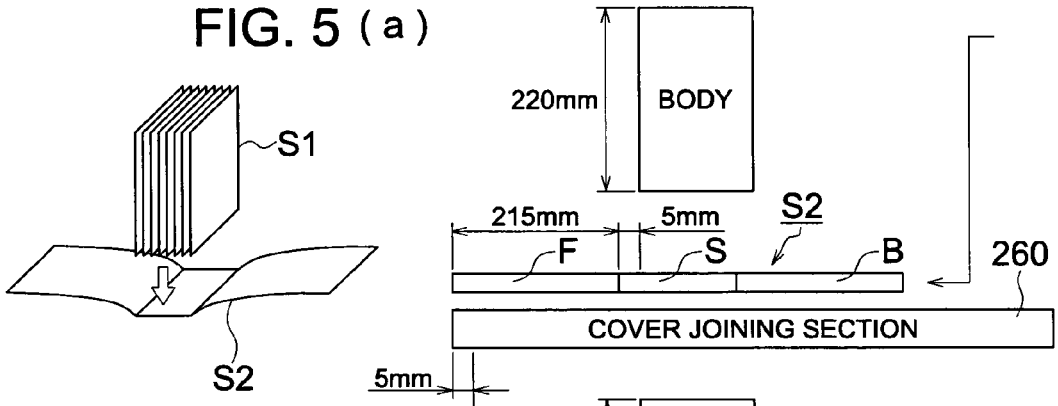
Figure 5:
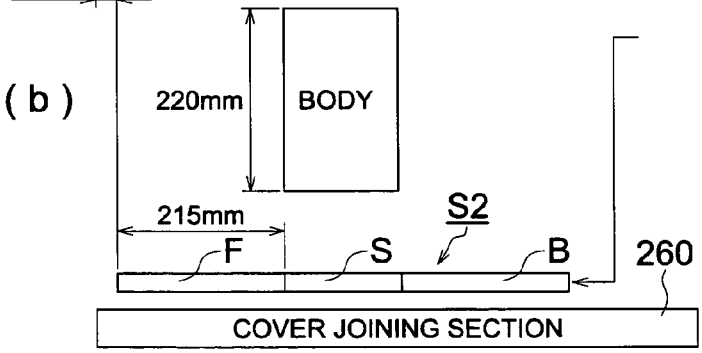

In step S304, CPU 290 controls the cover joining section 260 to stop the cover sheet S2 at a predetermined position in accordance with "cover-front-edge-position adjustment setting value: −5 mm" having been set in step S105 of the image data input processing (see FIG. 5). For example, a cover sheet S2 can be stopped at a predetermined position in the following manner. That is, a conveying roller is provided on the cover joining section 260 and driven by a sensor, which detects the front-edge of the cover S2, and a stepping motor. If the sensor has detected the front edge of the cover S2, then the stepping motor is driven for steps, based on "the cover-front-edge-position adjustment setting value: −5 mm, a cover-front-edge-position individual-variation adjustment setting value described later, and the size of the cover S2, and then the stepping motor is stopped. In this manner, the cover S2 is stopped at the predetermined position. In other words, the number of driving steps of the stepping motor to move the cover S2 is the sum of the number of steps corresponding to the size of the sheet S2 which is set for each respective job, the number of steps corresponding to the cover-front-edge-position adjustment setting value which is set for each respective job, and the number of steps corresponding to the cover-front-edge-position individual-variation adjustment setting value which is set for each individual device, of which details will be described later.

CPU 290 determines whether or not the ejected sheet is the last ejection sheet in step S305. If CPU 290 has determined that the ejected sheet is the last ejection sheet (step S305; Yes), then CPU 290 starts bookbinding processing (step S306). Thus, the body held by the sheet stack holding section 240 and the cover S2 loaded on the cover joining section 260 are adhered to each other with glue. If CPU 290 has determined that the ejected sheet is not the last ejection sheet (step S305; No), then the process returns to step S301.

[Cover-front-edge-position Individual-variation Adjustment]

Cover-front-edge-position individual-variation adjustment is for adjusting a micro variation from a reference cover stop position, wherein each bookbinding device has a unique micro variation. An inspector or service man carries out the cover-front-edge-position individual-variation adjustment during ex-factory inspection or maintenance.

Figure 10:
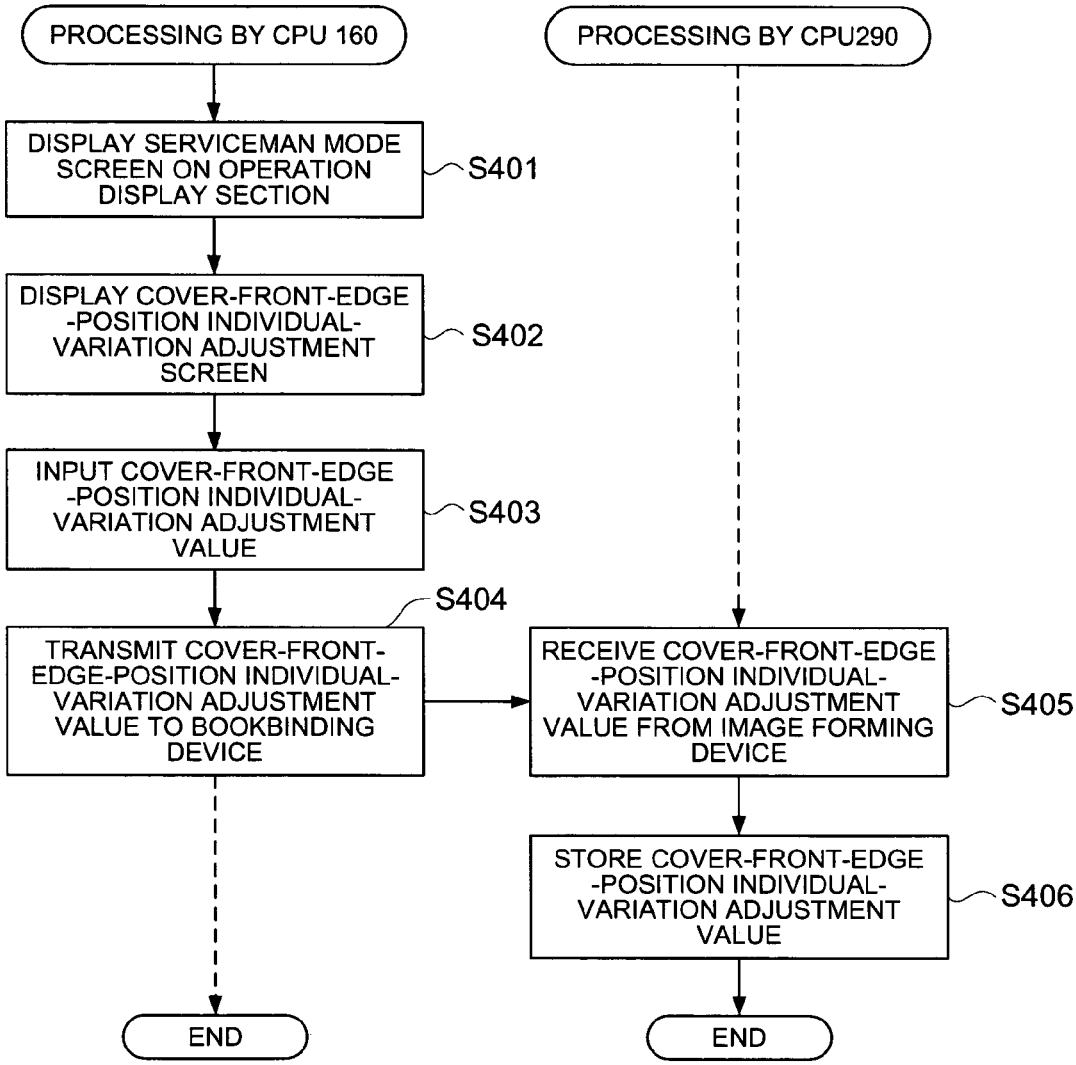
FIG. 10 is a diagram showing a setting flow of a cover-front-edge-position individual-variation adjustment value.

FIG. 10 shows the flow of setting a cover-front-edge-position individual-variation adjustment value in accordance with the present embodiment. This setting is carried out through collaboration between CPU 160 of the image forming device 100 and CPU 290 of the bookbinding device 200 to perform processing.

First, when a serviceman, for example, carries out a special operation unknown to a user via the operation display section 164 of the image forming device 100, CPU 160 displays a serviceman mode screen on the operation display section 164 that is not displayed with ordinary operation by a user (step S140).

Next, when a predetermined operation is carried out on the serviceman mode screen, CPU 160 displays the cover-front-edge-position individual-variation adjustment screen on the operation display section 164 (step S402).

Then, when a cover-front-edge-position individual-variation adjustment value is input on the cover-front-edge-position individual-variation adjustment screen (step S403), then CPU 160 transmits the cover-front-edge-position individual-variation adjustment value to the bookbinding device 200 via the communication section 165 (step S404).

Then, the cover-front-edge-position individual-variation adjustment value having been transmitted is received by the bookbinding device 200 via the communication section 295 (step S405).

Then, the cover-front-edge-position individual-variation adjustment value having been received is stored in a nonvolatile memory 294 by CPU 290 (step S406).

As stated above in the description of step S304, the stop position of a cover S2 is also adjusted by the cover-front-edge-position individual-variation adjustment value.

A serviceman adjusts the cover stop position to make it aligned with the reference cover stop position, changing the cover-front-edge-position individual-variation adjustment value and checking a book that is output.

In the present embodiment, an adjustment value has been directly input to set of the cover-front-edge-position individual-variation adjustment value. However, for example, it is also possible to input distance A from the front cover register marks FR and back cover register marks BR to the edges of the cover S2 and distance B from the body register marks HR to the edge of the body sheets S1, and calculate the adjustment value for the cover-front-edge-position, based on the input values. In the present embodiment, A=5 mm and B=10 mm, and an adjustment value "−5 mm" is obtained by calculating "−(B−A)". Further, it is also possible to output one copy for trial, and input an adjustment value for the cover-front-edge-position, taking a look at the deviation of a bound book.

In the present embodiment, a case has been described where a cover S2 having an image formed thereon in advance, as shown in FIG. 2*a*, is used, and an image, shown in FIG. 2*b*, is formed on the cover S2. However, in a case of using a blank cover S2, an object of the invention can be attained also by forming a cover image to be formed on a cover S2 with a shift instead of adjusting the cover-front-edge-position. For example, in FIG. 4*a*, if the cover image is shifted 5 mm toward the back cover area B, the front cover register marks FR move 5 mm to the left in the figure accompanied with the shift of the cover image so that the register marks FR are superposed on the positions of body register marks HR. Likewise, the back cover register marks BR move 5 mm to the right in the figure accompanied with the shift of the cover image so that the register marks BR are superposed on the positions of body register marks HR. In such a manner, the respective positions of the three register marks are aligned so that neither a part of the cover image nor the body images is lost by cutting the book at the register mark positions, which achieves bookbinding in high quality with the spine area S disposed properly at the spine of the book.

In the present embodiment, a case has been described where bookbinding is performed by cutting a body after wrapping the body with a cover S2. However, the invention is also applicable to bookbinding, with the length of the cover intentionally short, as shown in FIG. 11.

Figure 11:
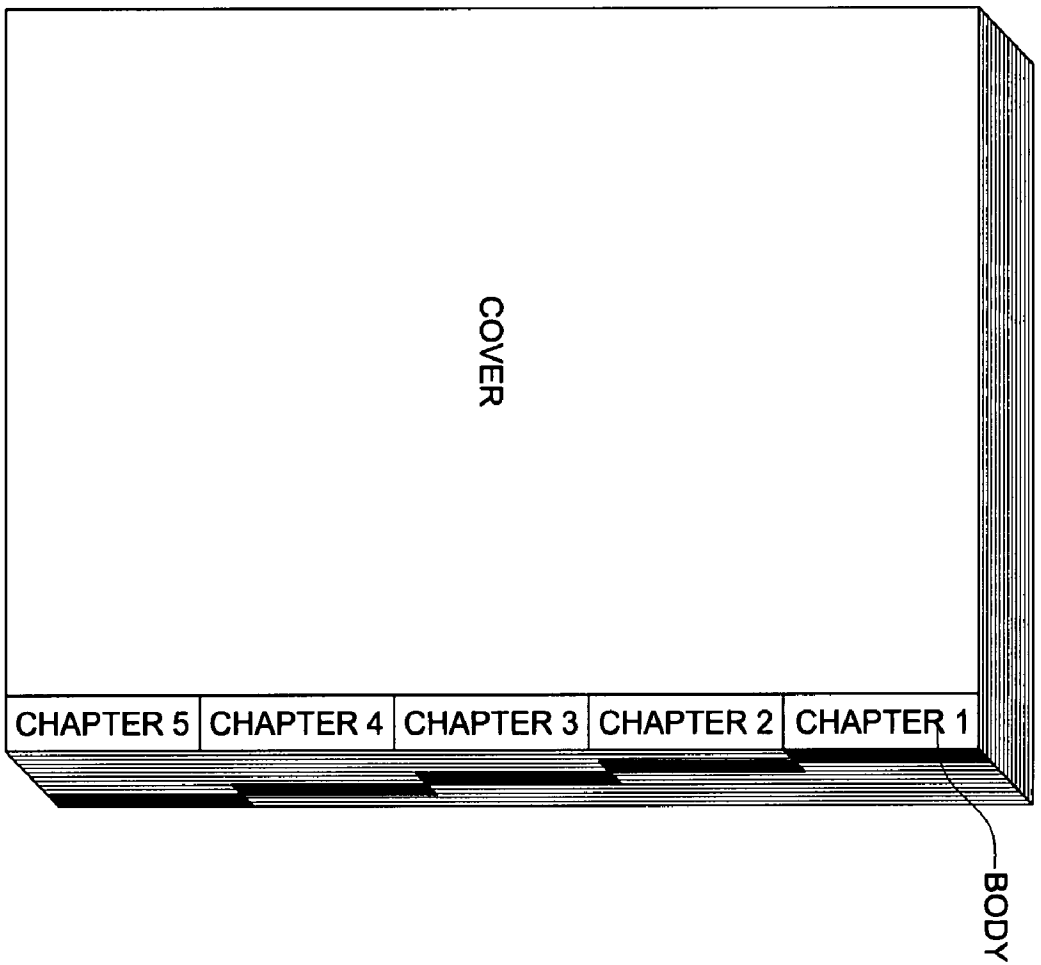
FIG. 11 is a diagram showing a state of a book where the front cover is formed intentionally shorter than the back cover in accordance with another embodiment.

In FIG. 11, the front cover is formed intentionally shorter than the back cover in the lateral direction. It is a book form often seen with catalogs, etc. An image is formed to be an index at the edge of a body sheet, and the length of the front cover is short so that the index portion can be seen from outside.

Even in this case, likewise in the present embodiment, setting of the cover-front-edge-position adjustment is carried out so as to shift the cover from the fore edge of the body, thereby enabling bookbinding, as shown in FIG. 11.

In the present embodiment, the relative position between the cover S2 and body has been set by changing the stop position of the cover conveyed to the cover joining section 260 with an input of the cover-front-edge-position adjustment setting value. However, the position of the sheet stack holding section 240 may be changed, with a structure allowing a change (in the left and right direction in FIG. 1) of the position of the sheet stack holding section 240 that holds the body.

In the present embodiment, image data has been input via the personal computer 300. However, image data may be input by reading the image of original document sheets with the image reading section 130 while conveying the original document sheets by the original document sheet conveying section 120 of the image forming device 100.

According to the invention, since it is possible to adjust the relative position between a cover and body sheets, bookbinding in high quality can be achieved, applicable to various wrap-bookbinding forms.

What is claimed is:

1. An image forming system that forms an image on body sheets and wraps, in a square shape, a stack of the body sheets having the image formed thereon with a cover to bind a book, comprising: a relative-position related information input section for input of information related to a relative position between the cover and the stack of the body sheets, wherein the information related to the relative position between the cover and the stack is variable from job to job; a storage section for storing the information related to the relative position, corresponding to a job; and a relative position control section for control of the relative position between the cover and the stack of the body sheets, based on the information related to the relative position stored in the storage section.

2. The image forming system of claim 1, wherein the relative position control section controls a relative position between, an edge of the cover corresponding to an edge of the stack of the body sheets to become a fore edge when the cover is joined with the body sheets, and the edge of the stack of the body sheets to become the fore edge.

3. The image forming system of claim 2, further comprising:

a joining section that joins the cover to the stack of the body sheets, wherein the relative position control section controls the relative position between the cover and the stack of the body sheets, the relative position taken when the joining section joins the cover to the stack of the body sheets.

4. The image forming system of claim 3, wherein the joining section comprises a detector for detecting the edge of the cover conveyed to the joining section; and the relative position control section controls a stop position of the cover conveyed to the joining section, based on detection of the edge of the cover by the detector and information related to the relative position stored in the storage section.

5. The image forming system of claim 1, further comprising:

an adjustment information input section for input of adjustment information for adjustment of a stop position of the cover; and a memory for storing the adjustment information inputted via the adjustment information input section, wherein the relative position control section controls the relative position between the cover and the stack of the body sheets, based on the adjustment information and the information related to the relative position.

6. The image forming system of claim 1, further comprising:

a cover-image shift-amount input section for input of a shift amount of image data for forming an image on the cover; and a cover-image shift control section for control of shifting the image data for forming the image on the cover, based on the shift amount inputted via the cover-image shift-amount input section.

7. The image forming system of claim 6, wherein input via the cover-image shift-amount input section can be carried out on a job to job basis.

8. The image forming system of claim 1, further comprising:

a body-image shift-amount input section for input of a shift amount of an image to be formed on a body sheet; and a body-image shift control section for control of shifting the image to be formed on the body sheet, based on the shift amount inputted via the body-image shift-amount input section.

9. The image forming system of claim 8, wherein input via the body-image shift-amount input section can be carried out on a job to job basis.

10. An image forming device that forms an image on body sheets and is connectable with a bookbinding device, the bookbinding device performing bookbinding by wrapping, in a square shape, a stack of the body sheets having the image formed thereon with a cover, the image forming device comprising: a relative-position related information input section for input of information related to a relative position between the cover and the stack of the body sheets, wherein the information related to the relative position between the cover and the stack is variable from job to job; a storage section for storing the information related to the relative position, corresponding to a job; and a transmitting section for transmitting the information related to the relative position Stored in the storage section, to the bookbinding device.

11. A bookbinding device that is connectable to an image forming device that forms an image on body sheets and performs bookbinding by wrapping, in a square shape, a stack of the body sheets having the image formed thereon with a cover, the bookbinding device comprising: a receiving section for receiving information related to a relative position between the cover and the stack of the body sheets, on a job to job basis, from the image forming device, wherein the information related to the relative position between the cover and the stack is variable from job to job: and a relative position control section for control of the relative position between the cover and the stack of the body sheets, based on the information related to the relative position and received by the receiving section.

12. The bookbinding device of claim 11, wherein the relative position control section controls a relative position between, an edge of the cover corresponding to an edge of the stack of the body sheets to become a fore edge when the cover is joined with the body sheets, and the edge of the stack of the body sheets to become the fore edge.

13. The bookbinding device of claim 12, further comprising:

a joining section that joins the cover to the stack of the body sheets, wherein the relative position control section controls the relative position between the cover and the stack of the body sheets, the relative position taken when the joining section joins the cover to the stack of the body sheets.

* * * * *